US006246846B1

(12) United States Patent
Hanashi

(10) Patent No.: US 6,246,846 B1
(45) Date of Patent: Jun. 12, 2001

(54) IMAGE HEATING APPARATUS WITH TEMPERATURE SETTING MEANS

(75) Inventor: Ryo Hanashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/382,815

(22) Filed: Aug. 25, 1999

(30) Foreign Application Priority Data

Aug. 31, 1998 (JP) ..... 10-245221

(51) Int. Cl.[7] ..... G03G 15/20
(52) U.S. Cl. ..... 399/70
(58) Field of Search ..... 399/67, 69, 70, 399/88, 320, 328, 335

(56) References Cited

U.S. PATENT DOCUMENTS

| | | | | |
|---|---|---|---|---|
| 5,300,996 | * | 4/1994 | Yokoyama et al. | 399/69 |
| 5,502,546 | * | 3/1996 | Muto | 399/335 X |
| 5,946,526 | * | 8/1999 | Kim | 399/70 |
| 5,960,233 | * | 9/1999 | Goto et al. | 399/69 |
| 5,987,274 | * | 11/1999 | Satoh | 399/69 |

* cited by examiner

*Primary Examiner*—Sandra Brase
(74) *Attorney, Agent, or Firm*—Fitzpatrick, Cella, Harper & Scinto

(57) ABSTRACT

The present invention relates to an image heating apparatus which has a heating member for heating an image on a recording material, and temperature setting means for setting the set temperature in accordance with a time period for waiting a printing command during the stand-by period.

6 Claims, 6 Drawing Sheets

| TIME FROM RELEASING WAIT (SECONDS) | 0 TO 60 | 61 TO 120 | FROM 121 |
|---|---|---|---|
| CONTROLLED TEMPERATURE BY TEMPERATURE CONTROL (°C) | 140 | 150 | 160 |

FIG. 6

| THE NUMBER OF TURNING ON FROM RELEASING WAIT | 1 TO 10 | 11 TO 20 | 21 TO 30 | 31 TO 40 | FROM 41 |
|---|---|---|---|---|---|
| CONTROLLED TEMPERATURE BY TEMPERATURE CONTROL(°C) | 140 | RAISE BY 1°C | 150 | RAISE BY 1°C | 160 |

FIG. 7

| DETECTED TEMPERATURE T IN START WAITING(°C) | TEMPERATURE IN RELEASEING WAITE(°C) | THE NUMBER OF TURNING ON FROM RELEASING WAIT AND CONTROLLED TEMPERATURE | | | | |
|---|---|---|---|---|---|---|
| | | 1 TO 10 | 11 TO 20 | 21 TO 30 | 31 TO 40 | FROM 41 |
| T≦40 | 140 | 140 | RAISE BY 1°C | 150 | RAISE BY 1°C | 160 |
| 40<T≦70 | 150 | 150 | RAISE BY 1°C | 160 | | |
| 70<T | 160 | 160 | | | | |

IMAGE HEATING APPARATUS WITH TEMPERATURE SETTING MEANS

BACKGROUND OF THE INVENTION

1. Field of the Invention

The present invention relates to a fixing apparatus used in a copying machine, a printer and the like for recording an image on a recording material in response to an original or image information.

2. Related Background Art

Conventionally, in image forming apparatuses, it is known to use a fixing apparatus having a thin wall fixing roller in order to reduce a rising time in power ON of a main body or in recovery after jam treatment. Further, in such a fixing apparatus, a thermistor (temperature detecting means) abuts against the surface of the fixing roller, and energization of a heater disposed within the fixing roller is controlled on the basis of a detected temperature from the thermistor.

However, when the thermistor is arranged within a sheet passing area of the fixing roller, contamination such as toner contamination is adhered to the surface of the thermistor during long term use to worsen temperature detecting accuracy, or an abutting trace of the thermistor is generated on the sheet passing area of the fixing roller to shorten the service life of the fixing roller.

To avoid this, it is considered that the thermistor is arranged in a non-sheet passing area or out of the sheet passing area of the fixing roller thereby to prevent the toner contamination on the thermistor and reduction in service life of the fixing roller.

In this case, however, since the temperature of the sheet passing area is not detected, temperature control of the sheet passing area of the fixing roller is not easy. Further, if heat capacity of the fixing roller is small, heat conductivity in the generatrix direction of the fixing roller becomes small.

In such a condition, energization of the heater is started by turning ON a power source of a main body of the image forming apparatus. Since the energization of the heater is continued until the detected temperature of the thermistor reaches a stand-by setting temperature (waiting condition is maintained in this time period), even if the heater is disenergized after the detected temperature of the thermistor reaches the stand-by setting temperature, the fixing roller is overshot due to its small heat capacity. Since the heat conductivity in the generatrix direction of the fixing roller is small, particularly the overshoot amount of a center portion of the fixing roller becomes great (refer to FIG. 3) in comparison with the small heat capacity.

It is preferable that the overshoot amount is reduced not to generate hot offset even when the copy (print) is started while the overshoot is being generated. Incidentally, since the fixing roller and pressing roller are rotated from a time t to a time 0 (FIG. 3), a temperature of the pressure roller is increased during this time period.

By the way, if there is no copy command after the waiting condition is released, the apparatus becomes a stand-by condition. In the stand-by condition, the energization of the heater is controlled so that the detected temperature of the thermistor is maintained to the setting temperature. Meanwhile, since the fixing roller and the pressing roller are not rotated to be kept stationary, the temperature of the pressing roller is gradually decreased (FIG. 3). Accordingly, the longer the stand-by time the smaller a heat accumulating amount of the pressing roller (particularly at both ends thereof having great heat discharging amount), thereby affect a bad influence upon improvement of fixing ability.

Although it is considered that the setting temperature in the stand-by condition is increased to solve the above problem, if doing so, the overshoot in the energization upon power ON becomes great.

SUMMARY OF THE INVENTION

The present invention aims to eliminate the above-mentioned conventional drawbacks, and an object of the present invention is to provide an image heating apparatus in which good fixing ability can be maintained even when a stand-by condition is lengthened.

Another object of the present invention is to provide an image heating apparatus comprising a heating member for heating an image on a recording material, the heating member being controlled so as to be maintained at a set temperature during a stand-by period, and temperature setting means for setting the set temperature in accordance with a time period for waiting a printing command during the stand-by period.

A further object of the present invention is to provide an image heating apparatus comprising a heating member for heating an image on a recording material, the heating member being controlled so as to be maintained at a set temperature during a stand-by period, and temperature setting means for setting the set temperature in accordance with a number of power supply to the heating member during the stand-by period.

A still further object of the present invention is to provide an image heating apparatus comprising a heating member, a temperature detecting element for detecting the heating member, power supply control means for controlling a power supply to the heating member so that the temperature detected by the temperature detecting element is maintained at a set temperature, and temperature setting means for setting the set temperature during a stand-by period in accordance with a detected temperature of the temperature detecting element upon start of power supply to the heating member.

The other objects and features of the present invention will be apparent from the following detailed explanation of the invention referring to the accompanying drawings.

BRIEF DESCRIPTION OF THE DRAWINGS

FIG. 6 is a table showing a second embodiment of the present invention;

FIG. 7 is a table showing a third embodiment of the present invention; and

DETAILED DESCRIPTION OF THE PREFERRED EMBODIMENTS

First of all, a first embodiment of the present invention will be explained.

Figure 1:
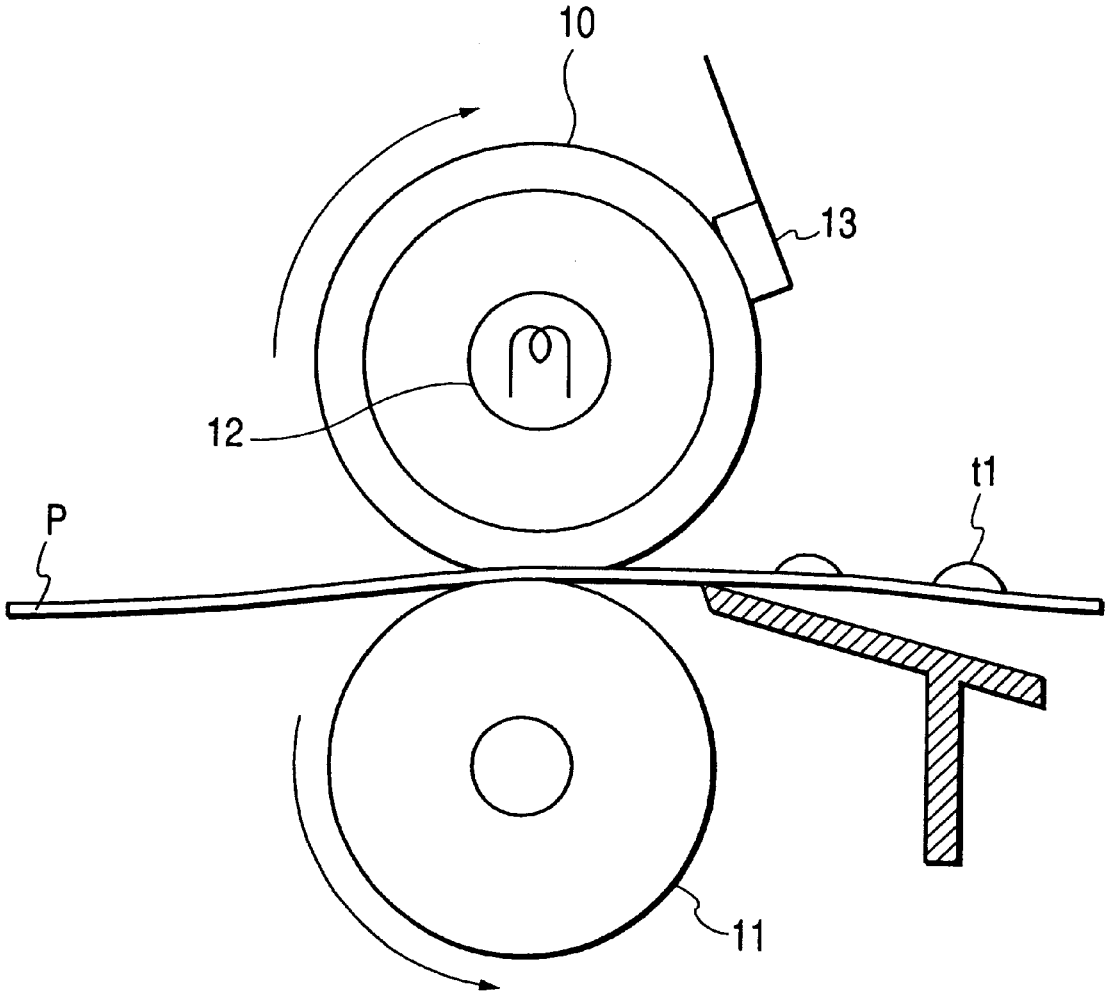
FIG. 1 is a sectional view of a fixing apparatus of the present invention.

FIG. 1 is a sectional view of a fixing apparatus of the present invention used with a copying machine. A fixing roller 10 is a hollow member having an outer diameter of 30 mm and a wall thickness of 0.8 mm, and a core metal is made of an aluminium and a fluororesin layer is coated on the core metal. A pressing roller 11 has an outer diameter of 25 mm and is constituted by coating a PFA tube on a silicone rubber layer.

The fixing roller 10 and the pressing roller 11 are urged against each other with total pressing pressure of 20 kgf by a pressing member (not shown) to form a nip (therebetween) for pinching and conveying a recording material. Further, these rollers are rotated by a driving device in a synchronous manner to convey the recording material.

A fixing heater 12 is disposed within the hollow fixing roller 10. The fixing heater 12 serves to heat the fixing roller (heating member) with consumption of electric power of about 600 Watts during energization.

Figures 2, 4:
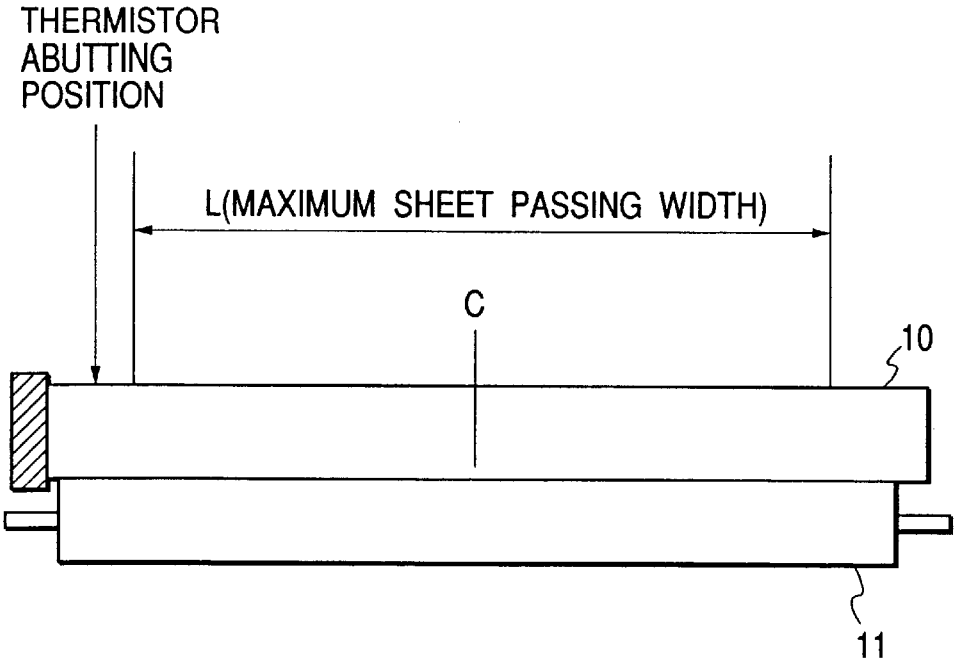
FIG. 2 is a plan view showing a thermistor abutting position and a maximum sheet passing width.
FIG. 4 is a table showing a first embodiment of the present invention.

A thermistor 13 abuts against the fixing roller 10 to detect a temperature of a surface of the fixing roller 10. Energization of the fixing heater 12 is controlled so that a detected temperature T becomes a predetermined temperature. Further, as shown in FIG. 2, the thermistor 13 is disposed at a position spaced apart from a sheet passing reference position (center position) C, i.e., a center of a maximum sheet passing width L (297 mm in A3 size) by 150 mm greater than 148.5 mm corresponding to the half of the maximum sheet passing width, thereby detecting a temperature of a non-sheet passing area.

A toner image t1 transferred to a recording material P by a known image forming process is conveyed to the nip between the fixing roller 10 and the pressing roller 11 by means of a conveying device (not shown). The toner image is heated and pressurized in the nip, thereby fixing the toner image to the recording material. A process speed of the image forming apparatus is 100 mm/sec so that sixteen imaged sheets can be obtained per minute.

A fixing temperature control sequence is as follows.

After the fixing heater starts to be energized by power ON from an inoperative condition, a waiting condition (inhibit copy, but permit reservation of copy) is maintained until the detected temperature of the thermistor 13 reaches a fixing permitting temperature of 140° C. in the image forming apparatus, and, when 140° C. is reached, the waiting condition is released to permit copy.

Further, in the illustrated embodiment, in the waiting condition, while the temperature is shifted from 120° C. to 140° C., the fixing apparatus effects pre-multi rotation to increase a temperature of the pressing roller. The temperature of the pressing roller is quickly increased by the pre-multi rotation and is quickly decreased after the pre-multi rotation is stopped. Thereafter, the temperature of the pressing roller is stabilized at a certain temperature.

In the waiting condition, if there is reservation of copy, a copying operation is started after the waiting condition is released. A temperature control sequence effected by the end thermistor during the copy is controled in which a temperature of the end portion is simulated if constant temperature control of the center portion is effected, i.e., control in which the set temperature is gradually increased as the number of turning ON of the heater is increased. More specifically, when the set temperature of the non-sheet passing area upon start of copy is 175° C., the set temperature when the heater is turned ON is 183° C., and the set temperature is then increased to 188° C. and ultimately increased to 193° C.

If there is no reservation of copy, the stand-by sequence is established.

Figure 3:
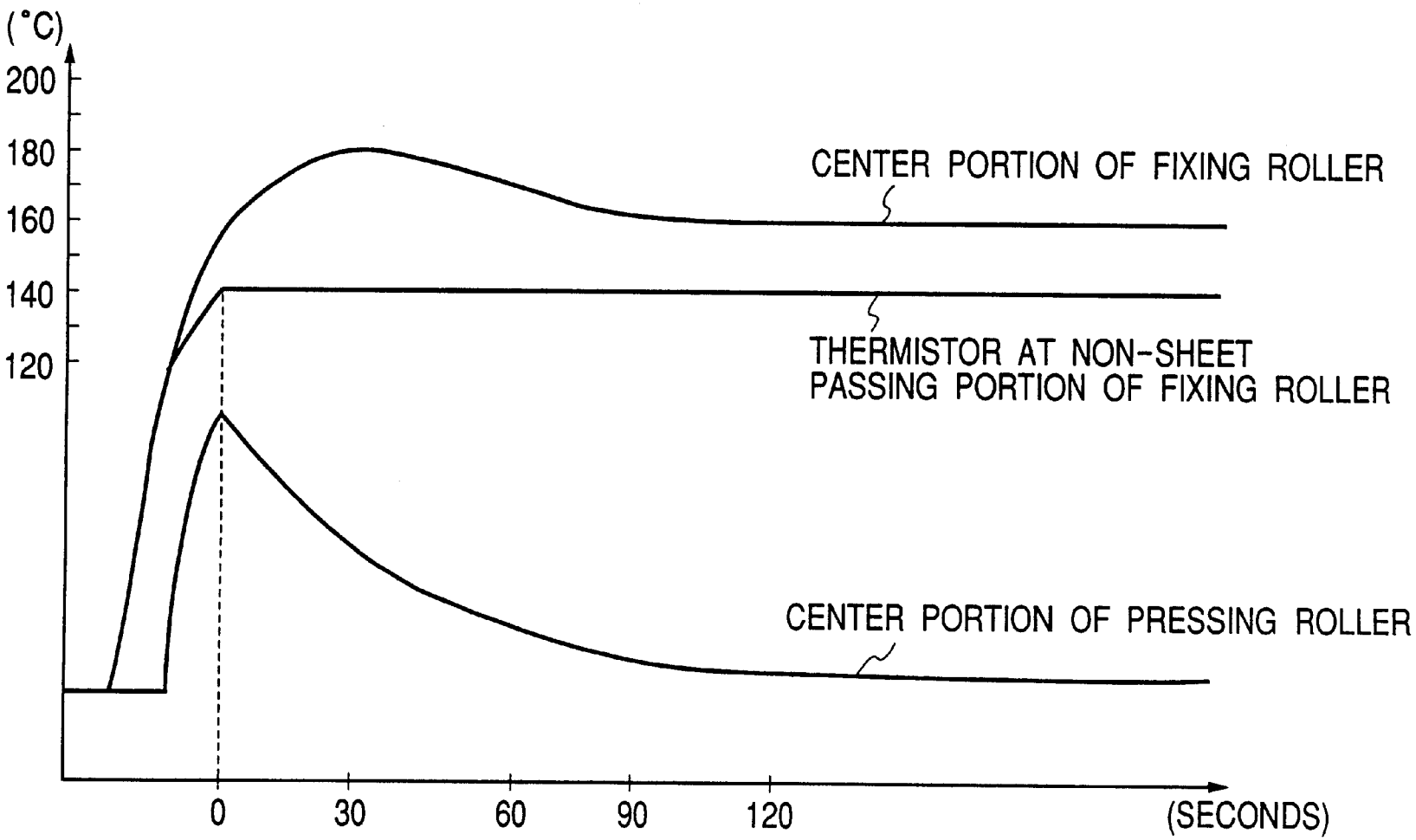
FIG. 3 is a graph showing change in temperatures of a fixing roller and a pressing roller when conventional control is effected.

FIG. 3 shows change in temperature of center portions of a fixing roller and a pressing roller when the constant temperature control stand-by control is effected in a conventional technique. A case where the waiting condition is released when the detected temperature of the non-sheet passing area reaches 140° C. to attain the constant temperature control of 140° C. is illustrated.

In this conventional control, when about 30 seconds are elapsed after the constant temperature control of 140° C. is attained, the temperature of the center portion of the fixing roller is over shot to a maximum value of 180° C. By the way, here, when the temperature of the center portion of the fixing roller is 160° C. to 180° C., good fixing ability is obtained. Further, in this timing, since the temperature of the pressing roller is also adequately high, there is no problem regarding the fixing ability throughout the entire recording material.

However, if the stand-by time becomes relatively long and the temperature of the pressing roller is low, when the copying operation is started, the fixing ability of both end portions (having low temperature in the stand-by condition) may be worsened.

In order to improve the fixing ability of both end portions, if the stand-by temperature control is effected at 160° C., when several seconds are elapse after the constant temperature control, the center portion will be overshot up to 200° C. In this condition, when the copying operation is started, high temperature offset will occur.

Figure 5:
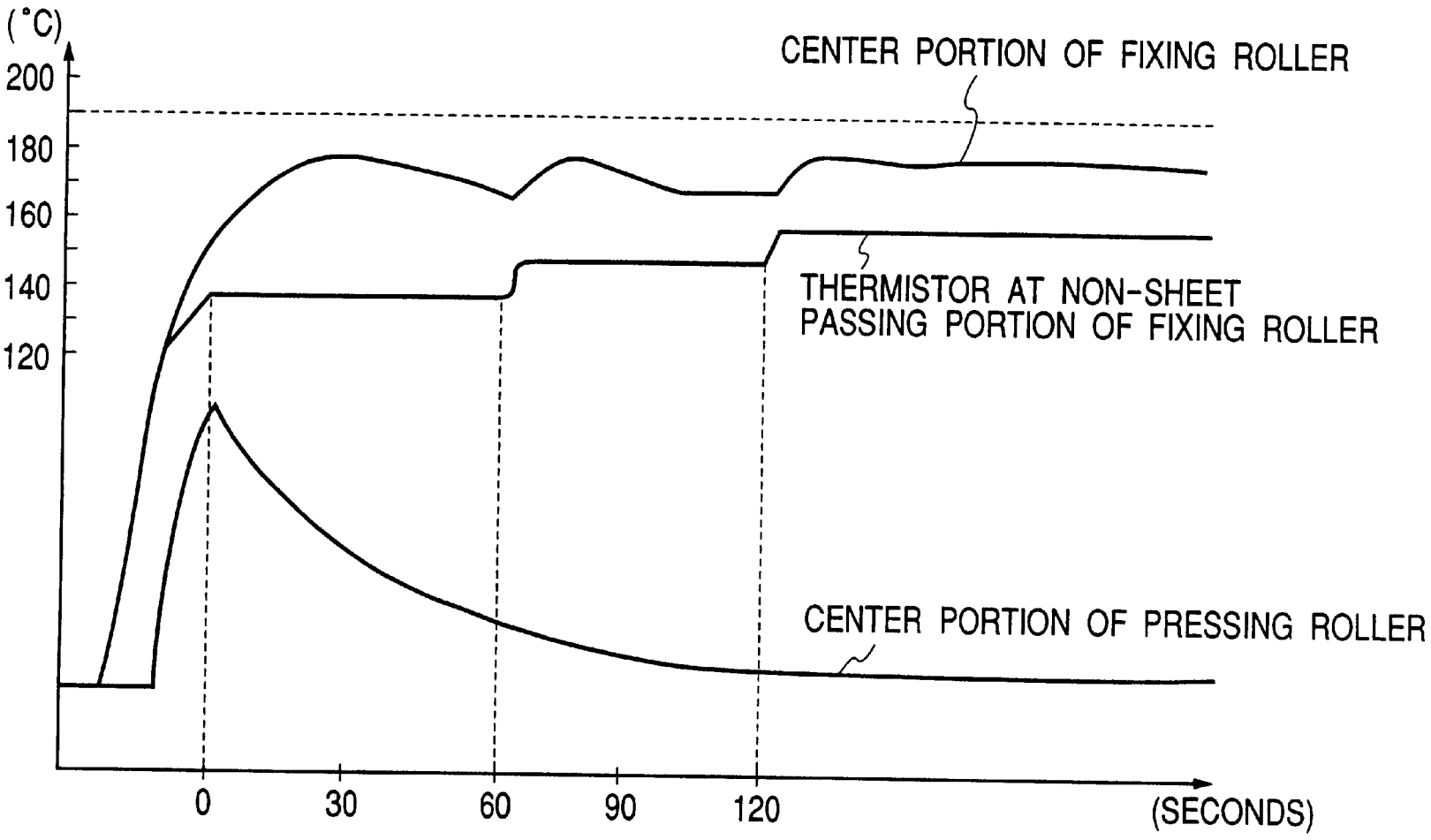
FIG. 5 is a graph showing change in temperatures of a fixing roller and a pressing roller when the first embodiment of the present invention is carried out.

To the contrary, FIG. 4 shows stand-by control according to the illustrated embodiment of the present invention, and FIG. 5 shows change in temperature of center portions of the fixing roller and pressing roller when such control is effected.

As shown in FIG. 4, during 60 seconds after the waiting condition is released, the stand-by temperature control is effected at 140° C., and, then, from 60 seconds to 120 seconds, the stand-by temperature control is effected at 150° C. After 120 seconds are elapsed, the temperature control is effected at 160° C.

During 60 seconds after the waiting condition is released, since the temperature control is effected at 140° C., the overshot of the center portion is suppressed to about 180° C., and, it was found that high temperature offset does not occur when the copying operation is started at this timing. Further, in this case, the temperature of the pressing roller is not decreased completely, so that there is no problem regarding the fixing ability.

After 120 seconds are elapsed, since the stand-by temperature is set to 160° C., even if the temperature of the pressing roller is lowered, poor fixing does not occur at both end portions. Further, the control temperature at both end portions is gradually increased after the stand-by condition, the temperature of the center portion does not exceed 190° C., thereby preventing high temperature offset.

As mentioned above, according to the illustrated embodiment, even when a fixing apparatus, in which the thin wall fixing roller is used to shorten the rising time of the entire apparatus and the temperature detecting element is provided at the non-sheet passing portion, is used, high temperature offset does not occur immediately after the waiting condition is released after power ON and poor fixing does not occur when a relatively long time period is elapsed after the stand-by condition is established.

[Second Embodiment]

Frequency of turning ON of the heater is changed in accordance with deflection of electric power supplied to the heater and/or change in a radiating condition of the fixing roller due to external environmental factors.

Thus, a time period from when the stand-by condition is started to when the temperature of the center portion reaches the highest temperature is varied, with the result that high temperature offset may occur if the frequency of turning ON is long and the reaching of the temperature of the center portion to the highest temperature is long.

A second embodiment of the present invention provides a fixing apparatus in which a level of a stand-by temperature is changed in accordance with the number of turning ON of the heater.

FIG. 6 shows stand-by temperature control according to the second embodiment of the present invention. In this embodiment, the switching of the stand-by temperature control is effected in accordance with the number of turning ON of the heater after the waiting condition is released.

Till the number of turning ON of the heater after the waiting condition of 140° C. becomes ten (10), the stand-by temperature control is effected at 140° C., and, thereafter, the temperature control temperature is increased or raised by 1° C., and, after the temperature control temperature reaches 150° C., the heater is turn ON by ten times. Thereafter, the temperature control temperature is further increased by 1° C., and, after the temperature control temperature reaches 160° C., the stand-by temperature control of 160° C. is effected.

In this way, by changing the level of the stand-by temperature in accordance with the number of power supply to the heater from the start of the stand-by, deflection or fluctuation of electric power supplied to the heater and external environmental temperature is eliminated, thereby obtaining a fixing apparatus having no high temperature offset without increasing cost.

[Third Embodiment]

When the power supply of the main body is turned ON immediately after the power supply is turned OFF after continuous small size sheet passing or when the main body is restored after the energization (power supply) to the heater is stopped due to sheet jam, if the waiting condition is released on the basis of the detected temperature of the thermistor, in the image forming operation immediately after the releasing of the waiting condition, the temperature of the center portion is insufficient so that poor fixing may occur.

To avoid this, conventionally, in some apparatuses, pre-multi rotation has been performed for a predetermined time period.

However, in such a method, since the pre-multi rotation is effected even when the pre-multi rotation is not required, the apparatus cannot be used for the predetermined time period, thereby reducing the productivity and increasing power consumption.

To improve this, in a third embodiment of the present invention, a waiting condition releasing temperature and a stand-by temperature are changed in accordance with the surface temperature of the fixing roller upon power ON.

FIG. 7 shows the third embodiment of the present invention.

For example, the temperature upon power ON is 60° C., the waiting condition releasing temperature is set to 150° C., and, after the heater is turned ON by ten times at 150° C. from the releasing of the waiting condition, the temperature control temperature is increased by 1° C. up to 160° C.

Figure 8:
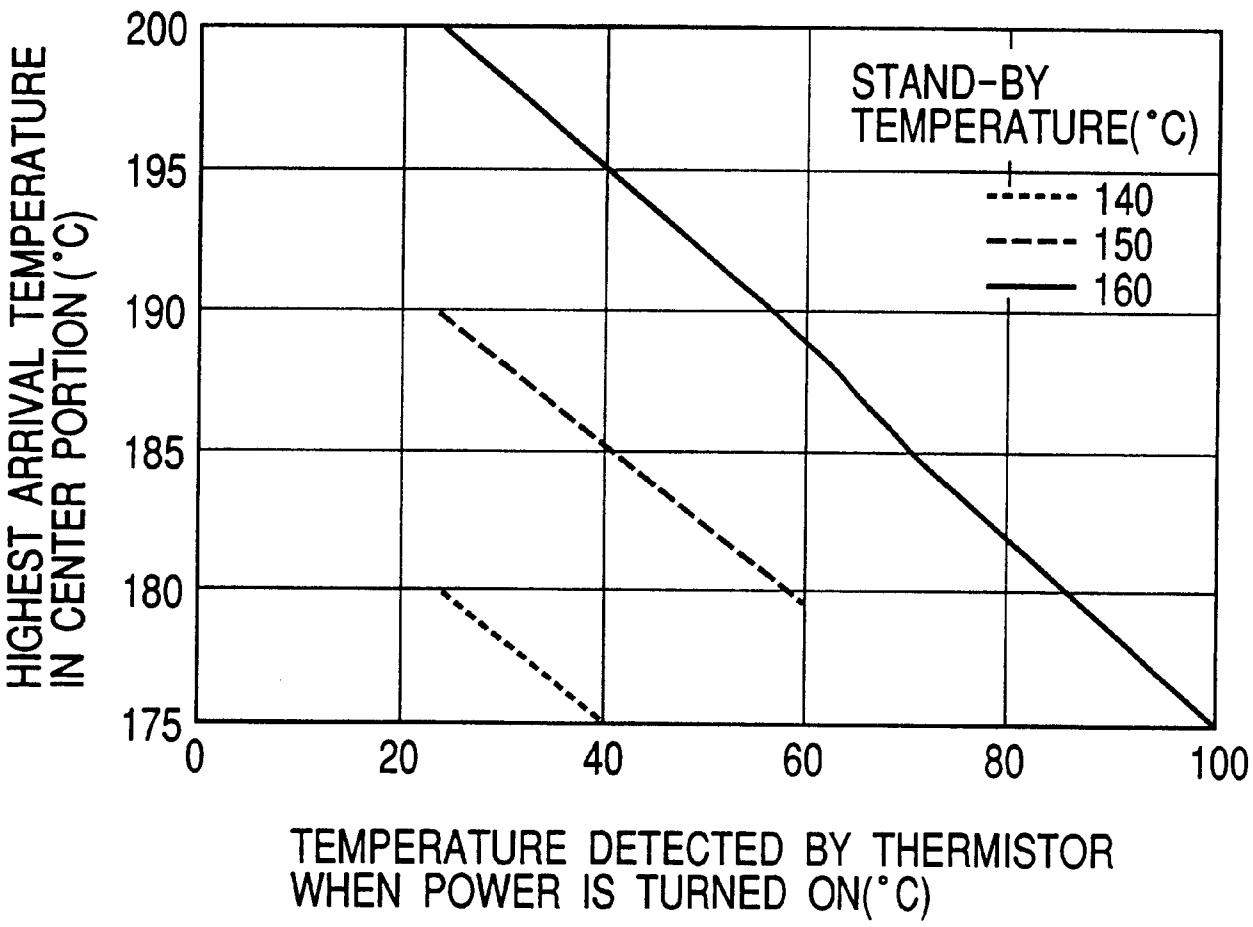
FIG. 8 is a graph showing a relationship between a temperature detected by a thermistor when power is turned ON and a highest arrival temperature in a central portion by a stand-by temperature.

FIG. 8 is a graph showing a dependency of a highest arrival temperature of the center portion on the temperature detected by the thermistor when power source is turned ON and the stand-by temperature.

In this way, the highest arrival temperature of the center portion substantially depends upon the temperature detected by the thermistor when power source is turned ON and the stand-by temperature. Thus, when the detected temperature of the thermistor is relatively high upon power ON or recovery condition of the main body, even if the waiting condition releasing temperature is set to higher, the overshot is hard to occur, thereby preventing high temperature offset and improving the fixing ability at both end portions. Further, with this arrangement, since the undesired pre-multi rotation is not required, reduction in the productivity can be prevented and power consumption can be suppressed.

According to the present invention, even when the fixing apparatus in which the thin wall fixing roller is used and the temperature detecting element for detecting the temperature of the non-sheet passing portion is provided is used, high temperature offset does not occur after power ON and poor fixing does not occur.

The present invention is not limited to the above-mentioned embodiments, and various alterations can be made within the scope of the invention.

What is claimed is:

1. An image heating apparatus comprising:

a heating member for heating an image on a recording material, said heating member being controlled so as to be maintained at a set temperature during a stand-by period; and temperature setting means for setting the set temperature in accordance with a time period for awaiting a printing command during the stand-by period, wherein said temperature setting means sets the set temperature higher as the waiting time period is longer.

2. An image heating apparatus according to claim 1, further comprising a temperature detecting element for detecting a temperature of a recording material non-passing area of said heating member, and power supply control means for controlling a power supply to said heating member so that the temperature detected by said temperature detecting element is maintained at the set temperature.

3. An image heating apparatus comprising:

a heating member for heating an image on a recording material, said heating member being controlled so as to be maintained at a set temperature during a stand-by period; and temperature setting means for setting the set temperature in accordance with a number of on-off power supply cycles to said heating member during the stand-by period, wherein said temperature setting means sets the set temperature higher as the number of on-off power supply cycle is greater.

4. An image heating apparatus according to claim 3, further comprising a temperature detecting element for detecting a temperature of a recording material non-passing area of said heating member, and power supply control means for controlling a power supply to said heating member so that the temperature detected by said temperature detecting element is maintained at the set temperature.

5. An image heating apparatus for heating an image on a recording material, comprising:

a heating member;

a temperature detecting element for detecting a temperature of said heating member;

power supply control means for controlling a power supply to said heating member so that the temperature detected by said temperature detecting element is maintained at a set temperature; and temperature setting means for setting the set temperature during a stand-by period in accordance with the temperature detected by said temperature detecting element upon start of power supply to said heating member.

6. An image heating apparatus according to claim 5, wherein said temperature detecting element detects a temperature of a recording material non-passing area of said heating member.

* * * * *

UNITED STATES PATENT AND TRADEMARK OFFICE

CERTIFICATE OF CORRECTION

PATENT NO. : 6,246,846 B1
DATED : June 12, 2001
INVENTOR(S) : Ryo Hanashi

It is certified that error appears in the above-identified patent and that said Letters Patent is hereby corrected as shown below:

Sheet No. 5,
Figure 7, "RELEASEING WAITEING (°C)" should read -- RELEASING WAITING (°C) --.

Column 3,
Line 56, "controled" should read -- controlled --.

Column 6,
Line 61, "cycle" should read -- cycles --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*